US010536794B2

(12) United States Patent
Eronen et al.

(10) Patent No.: US 10,536,794 B2
(45) Date of Patent: Jan. 14, 2020

(54) INTELLIGENT AUDIO RENDERING

(71) Applicant: Nokia Technologies Oy, Espoo (FI)

(72) Inventors: Antti Eronen, Tampere (FI); Jussi Leppänen, Tampere (FI); Arto Lehtiniemi, Lempäälä (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/778,451

(22) PCT Filed: Nov. 23, 2016

(86) PCT No.: PCT/FI2016/050824
§ 371 (c)(1),
(2) Date: May 23, 2018

(87) PCT Pub. No.: WO2017/089653
PCT Pub. Date: Jun. 1, 2017

(65) Prior Publication Data

US 2018/0352363 A1 Dec. 6, 2018

(30) Foreign Application Priority Data

Nov. 27, 2015 (EP) ..... 15196884

(51) Int. Cl.
*H04S 7/00* (2006.01)
*H04S 3/00* (2006.01)

(52) U.S. Cl.
CPC ..... *H04S 7/304* (2013.01); *H04S 3/008* (2013.01); *H04S 7/30* (2013.01); *H04S 7/303* (2013.01);
(Continued)

(58) Field of Classification Search
CPC . H04S 7/304; H04S 7/30; H04S 7/303; H04S 7/302; H04S 3/008; H04S 3/002;
(Continued)

(56) References Cited

U.S. PATENT DOCUMENTS 6,021,206 A 2/2000 McGrath
9,456,289 B2 9/2016 Tammi et al.
(Continued)

FOREIGN PATENT DOCUMENTS

EP 3174005 A1 5/2017
GB 2543275 A 4/2017
(Continued)

OTHER PUBLICATIONS

Office action received for corresponding European Patent Application No. 15196884.9, dated Nov. 6, 2018, 1 page.
(Continued)

*Primary Examiner* — Ahmad F. Matar
*Assistant Examiner* — Sabrina Diaz
(74) *Attorney, Agent, or Firm* — Harrington & Smith

(57) ABSTRACT

A method comprising: automatically applying a selection criterion or criteria to a sound object; if the sound object satisfies the selection criterion or criteria then performing one of correct or incorrect rendering of the sound object; and if the sound object does not satisfy the selection criterion or criteria then performing the other of correct or incorrect rendering of the sound object, wherein correct rendering of the sound object comprises at least rendering the sound object at a correct position within a rendered sound scene compared to a recorded sound scene and wherein incorrect rendering of the sound object comprises at least rendering of the sound object at an incorrect position in a rendered sound scene compared to a recorded sound scene.

17 Claims, 4 Drawing Sheets

(52) U.S. Cl.
CPC ..... *H04S 2400/01* (2013.01); *H04S 2400/11* (2013.01); *H04S 2400/13* (2013.01)

(58) Field of Classification Search
CPC ..... H04S 2400/01; H04S 2400/11; H04S 2400/13; H04S 2420/13
USPC ..... 381/303, 310, 309

See application file for complete search history.

(56) References Cited

U.S. PATENT DOCUMENTS

| | | | | |
|---|---|---|---|---|
| 9,860,666 | B2 | 1/2018 | Laitinen | |
| 2003/0223603 | A1 | 12/2003 | Beckman | |
| 2014/0211969 | A1* | 7/2014 | Kim | H03G 3/04 381/109 |
| 2015/0382127 | A1* | 12/2015 | Sun | H04S 7/30 381/17 |

FOREIGN PATENT DOCUMENTS

| | | | |
|---|---|---|---|
| GB | 2543276 | A | 4/2017 |
| WO | 2014/099285 | A1 | 6/2014 |
| WO | 2014/165326 | A1 | 10/2014 |
| WO | 2015/150384 | A1 | 10/2015 |

OTHER PUBLICATIONS

"Live Television Audio Mixing—Nov. BYU Volleyball Mixlapse", Youtube, Retrieved on May 11, 2018, Webpage available at : https://www.youtube.com/watch?v=hukWwBEvMT4.

"MPEG-H 3D Audio", Wikipedia, Retrieved on May 4, 2018, Webpage available at : https://en.wikipedia.org/wiki/MPEG-H_3D_Audio.

Extended European Search Report received for corresponding European Patent Application No. 15196884.9, dated Apr. 21, 2016, 10 pages.

International Search Report and Written Opinion received for corresponding Patent Cooperation Treaty Application No. PCT/FI2016/050824, dated Feb. 6, 2017, 15 pages.

Office action received for corresponding European Patent Application No. 15196884.9, dated Mar. 13, 2018, 6 pages.

Huang et al., "Acoustic Source Localization in Mixed Field Using Spherical Microphone Arrays", EURASIP Journal on Advances in Signal Processing, Jun. 2014, pp. 1-16.

Extended European Search Report received for corresponding European Patent Application No. 15196881.5, dated Apr. 21, 2016, 10 pages.

International Search Report and Written Opinion received for corresponding Patent Cooperation Treaty Application No. PCT/FI2016/050819, dated Feb. 6, 2017, 14 pages.

Office action received for corresponding European Patent Application No. 15196881.5, dated Mar. 13, 2018, 6 pages.

Office Action received for corresponding European Patent Application No. 15196881.5, dated Nov. 6, 2018, 5 pages.

* cited by examiner

INTELLIGENT AUDIO RENDERING

RELATED APPLICATION

This application was originally filed as Patent Cooperation Treaty Application No. PCT/FI2016/050824 filed Nov. 23, 2016 which claims priority benefit to European Patent Application No. 15196884.9, filed Nov. 27, 2015.

TECHNOLOGICAL FIELD

Embodiments of the present invention relate to intelligent audio rendering. In particular, they relate to intelligent audio rendering of a sound scene comprising multiple sound objects.

BACKGROUND

A sound scene in this document is used to refer to the arrangement of sound sources in a three-dimensional space. When a sound source changes position, the sound scene changes. When the sound source changes its audio properties such as its audio output, then the sound scene changes.

A sound scene may be defined in relation to recording sounds (a recorded sound scene) and in relation to rendering sounds (a rendered sound scene).

Some current technology focuses on accurately reproducing a recorded sound scene as a rendered sound scene at a distance in time and space from the recorded sound scene. The recorded sound scene is encoded for storage and/or transmission.

A sound object within a sound scene may be a source sound object that represents a sound source within the sound scene or may be a recorded sound object which represents sounds recorded at a particular microphone. In this document, reference to a sound object refers to both a recorded sound object and a source sound object. However, in some examples, the sound object may be only source sound objects and in other examples a sound object may be only a recorded sound object.

By using audio processing it may be possible, in some circumstances, to convert a recorded sound object into a source sound object and/or to convert a source sound object into a recorded sound object.

It may be desirable in some circumstances to record an audio scene using multiple microphones. Some microphones, such as Lavalier microphones, or other portable microphones, may be attached to or may follow a sound source in the sound scene. Other microphones may be static in the sound scene.

The combination of outputs from the various microphones defines a recorded sound scene. However, it may not always be desirable to render the sound scene exactly as it has been recorded. It is therefore desirable, in some circumstances, to automatically adapt the recorded sound scene to produce an alternative rendered sound scene.

BRIEF SUMMARY

According to various, but not necessarily all, embodiments of the invention there is provided a method comprising: automatically applying a selection criterion or criteria to a sound object; if the sound object satisfies the selection criterion or criteria then performing one of correct or incorrect rendering of the sound object; and if the sound object does not satisfy the selection criterion or criteria then performing the other of correct or incorrect rendering of the sound object, wherein correct rendering of the sound object comprises at least rendering the sound object at a correct position within a rendered sound scene compared to a recorded sound scene and wherein incorrect rendering of the sound object comprises at least rendering of the sound object at an incorrect position in a rendered sound scene compared to a recorded sound.

According to various, but not necessarily all, embodiments of the invention there is provided an apparatus comprising: means for determining automatically if a sound object does or does not satisfy a selection criterion or criteria; means for performing one of correct or incorrect rendering of the sound object if the sound object satisfies the selection criterion or criteria; and means for performing the other of correct or incorrect rendering of the sound object if the sound object does not satisfy the selection criterion or criteria, wherein correct rendering of the sound object comprises at least rendering the sound object at a correct position within a rendered sound scene compared to a recorded sound scene and wherein incorrect rendering of the sound object comprises at least rendering of the sound object at an incorrect position in a rendered sound scene compared to a recorded sound.

According to various, but not necessarily all, embodiments of the invention there is provided an apparatus comprising: at least one processor; and at least one memory including computer program code;

the at least one memory and the computer program code configured to, with the at least one processor, cause the apparatus at least to perform:

automatically applying a selection criterion or criteria to a sound object;

if the sound object satisfies the selection criterion or criteria then causing performance of one of correct or incorrect rendering of the sound object; and if the sound object does not satisfy the selection criterion or criteria then causing performance of the other of correct or incorrect rendering of the sound object, wherein correct rendering of the sound object comprises at least rendering the sound object at a correct position within a rendered sound scene compared to a recorded sound scene and wherein incorrect rendering of the sound object comprises at least rendering of the sound object at an incorrect position in a rendered sound scene compared to a recorded sound scene.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which:

FIG. 1 illustrates an example of a system and also an example of a method for recording and encoding a sound scene;

FIG. 2 schematically illustrates relative positions of a portable microphone (PM) and static microphone (SM) relative to an arbitrary reference point (REF);

DETAILED DESCRIPTION

Figure 1:
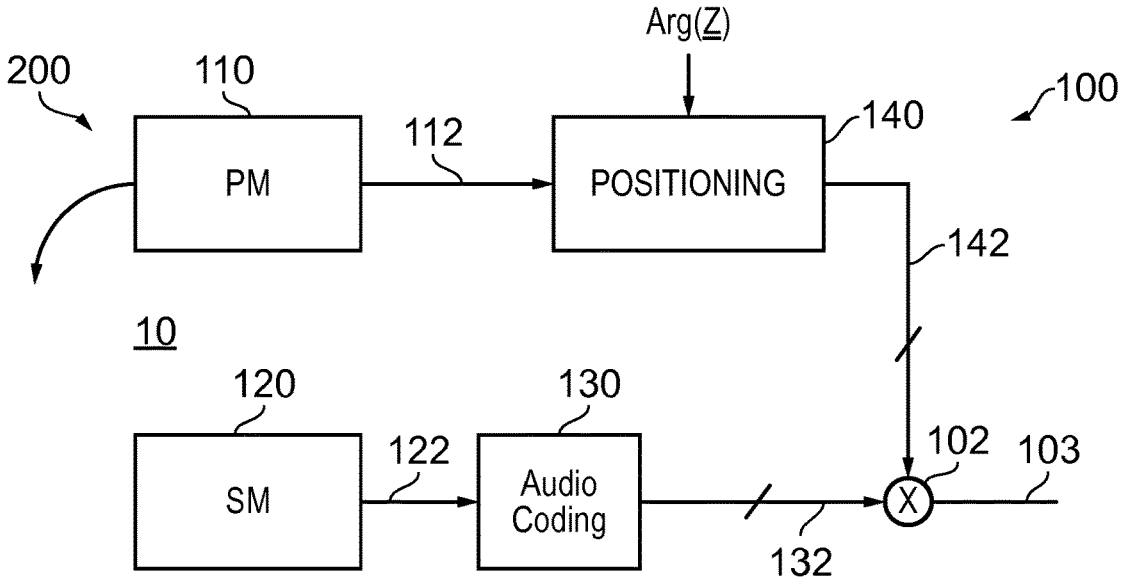

FIG. 1 illustrates an example of a system 100 and also an example of a method 200. The system 100 and method 200 record a sound scene 10 and process the recorded sound scene to enable an accurate rendering of the recorded sound scene as a rendered sound scene for a listener at a particular position (the origin) within the recorded sound scene 10.

In this example, the origin of the sound scene is at a microphone 120. In this example, the microphone 120 is static. It may record one or more channels, for example it may be a microphone array.

In this example, only a single static microphone 120 is illustrated. However, in other examples multiple static microphones 120 may be used independently or no static microphones may be used. In such circumstances the origin may be at any one of these static microphones 120 and it may be desirable to switch, in some circumstances, the origin between static microphones 120 or to position the origin at an arbitrary position within the sound scene.

The system 100 also comprises one or more portable microphones 110. The portable microphone 110 may, for example, move with a sound source within the recorded sound scene 10. This may be achieved, for example, using a boom microphone or, for example, attaching the microphone to the sound source, for example, by using a Lavalier microphone. The portable microphone 110 may record one or more recording channels.

Figure 2:
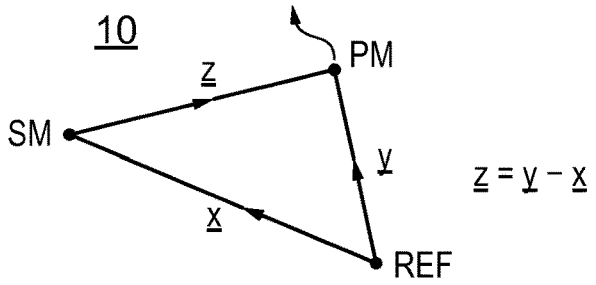

FIG. 2 schematically illustrates the relative positions of the portable microphone (PM) 110 and the static microphone (SM) 120 relative to an arbitrary reference point (REF). The position of the static microphone 120 relative to the reference point REF is represented by the vector $\underline{x}$. The position of the portable microphone PM relative to the reference point REF is represented by the vector $\underline{y}$. The relative position of the portable microphone 110 from the static microphone SM is represented by the vector $\underline{z}$. It will be understood that $\underline{z}=\underline{y}-\underline{x}$. As the static microphone SM is static, the vector $\underline{x}$ is constant. Therefore, if one has knowledge of $\underline{x}$ and tracks variations in $\underline{y}$, it is possible to also track variations in $\underline{z}$. The vector $\underline{z}$ gives the relative position of the portable microphone 110 relative to the static microphone 120 which is the origin of the sound scene 10. The vector $\underline{z}$ therefore positions the portable microphone 110 relative to a notional listener of the recorded sound scene 10.

There are many different technologies that may be used to position an object including passive systems where the positioned object is passive and does not produce a signal and active systems where the positioned object produces a signal. An example of a passive system, used in the Kinnect™ device, is when an object is painted with a non-homogenous pattern of symbols using infrared light and the reflected light is measured using multiple cameras and then processed, using the parallax effect, to determine a position of the object. An example of an active system is when an object has a transmitter that transmits a radio signal to multiple receivers to enable the object to be positioned by, for example, trilateration. An example of an active system is when an object has a receiver or receivers that receive a radio signal from multiple transmitters to enable the object to be positioned by, for example, trilateration.

When the sound scene 10 as recorded is rendered to a user (listener) by the system 100 in FIG. 1, it is rendered to the listener as if the listener is positioned at the origin of the recorded sound scene 10. It is therefore important that, as the portable microphone 110 moves in the recorded sound scene 10, its position $\underline{z}$ relative to the origin of the recorded sound scene 10 is tracked and is correctly represented in the rendered sound scene. The system 100 is configured to achieve this.

In the example of FIG. 1, the audio signals 122 output from the static microphone 120 are coded by audio coder 130 into a multichannel audio signal 132. If multiple static microphones were present, the output of each would be separately coded by an audio coder into a multichannel audio signal.

The audio coder 130 may be a spatial audio coder such that the multichannels 132 represent the sound scene 10 as recorded by the static microphone 120 and can be rendered giving a spatial audio effect. For example, the audio coder 130 may be configured to produce multichannel audio signals 132 according to a defined standard such as, for example, binaural coding, 5.1 surround sound coding, 7.1 surround sound coding etc. If multiple static microphones were present, the multichannel signal of each static microphone would be produced according to the same defined standard such as, for example, binaural coding, 5.1 surround sound coding, 7.1 and in relation to the same common rendered sound scene.

The multichannel audio signals 132 from one or more the static microphones 120 are mixed by mixer 102 with a multichannel audio signals 142 from the one or more portable microphones 110 to produce a multi-microphone multichannel audio signal 103 that represents the recorded sound scene 10 relative to the origin and which can be rendered by an audio decoder corresponding to the audio coder 130 to reproduce a rendered sound scene to a listener that corresponds to the recorded sound scene when the listener is at the origin.

The multichannel audio signal 142 from the, or each, portable microphone 110 is processed before mixing to take account of any movement of the portable microphone 110 relative to the origin at the static microphone 120.

The audio signals 112 output from the portable microphone 110 are processed by the positioning block 140 to adjust for movement of the portable microphone 110 relative to the origin at static microphone 120. The positioning block 140 takes as an input the vector $\underline{z}$ or some parameter or parameters dependent upon the vector $\underline{z}$. The vector $\underline{z}$ represents the relative position of the portable microphone 110 relative to the origin at the static microphone 120.

The positioning block 140 may be configured to adjust for any time misalignment between the audio signals 112 recorded by the portable microphone 110 and the audio signals 122 recorded by the static microphone 120 so that they share a common time reference frame. This may be achieved, for example, by correlating naturally occurring or artificially introduced (non-audible) audio signals that are present within the audio signals 112 from the portable microphone 110 with those within the audio signals 122 from the static microphone 120. Any timing offset identified by the correlation may be used to delay/advance the audio signals 112 from the portable microphone 110 before processing by the positioning block 140.

The positioning block 140 processes the audio signals 112 from the portable microphone 110, taking into account the relative orientation (Arg($\underline{z}$)) of that portable microphone 110 relative to the origin at the static microphone 120.

The audio coding of the static microphone audio signals 122 to produce the multichannel audio signal 132 assumes a particular orientation of the rendered sound scene relative to an orientation of the recorded sound scene and the audio signals 122 are encoded to the multichannel audio signals 132 accordingly.

The relative orientation Arg ($\underline{z}$) of the portable microphone 110 in the recorded sound scene 10 is determined and the audio signals 112 representing the sound object are coded to the multichannels defined by the audio coding 130 such that the sound object is correctly oriented within the rendered sound scene at a relative orientation Arg ($\underline{z}$) from the listener. For example, the audio signals 112 may first be mixed or encoded into the multichannel signals 142 and then a transformation T may be used to rotate the multichannel audio signals 142, representing the moving sound object, within the space defined by those multiple channels by Arg ($\underline{z}$).

Figure 4A:
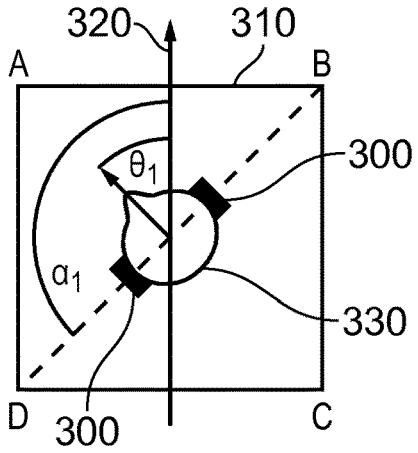
FIGS. 4A and 4B illustrate a change in relative orientation between a listener and the rendered sound scene so that the rendered sound scene remains fixed in space.
Figure 4B:
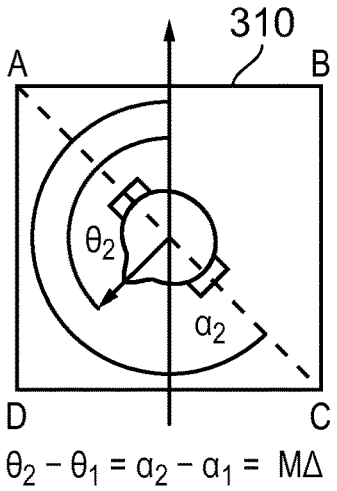

Referring to FIGS. 4A and 4B, in some situations, for example when the audio scene is rendered to a listener through a head-mounted audio output device 300, for example headphones using binaural audio coding, it may be desirable for the rendered sound scene 310 to remain fixed in space 320 when the listener turns their head 330 in space. This means that the rendered sound scene 310 needs to be rotated relative to the audio output device 300 by the same amount in the opposite sense to the head rotation.

In FIGS. 4A and 4B, the relative orientation between the listener and the rendered sound scene 310 is represented by an angle $\theta$. The sound scene is rendered by the audio output device 300 which physically rotates in the space 320. The relative orientation between the audio output device 300 and the rendered sound scene 310 is represented by an angle $\alpha$. As the audio output device 300 does not move relative to the user's head 330 there is a fixed offset between $\theta$ and a of 90° in this example. When the user turns their head $\theta$ changes. If the audio scene is to be rendered as fixed in space then a must change by the same amount in the same sense.

Moving from FIG. 4A to 4B, the user turns their head clockwise increasing $\theta$ by magnitude $\Delta$ and increasing $\alpha$ by magnitude $\Delta$. The rendered sound scene is rotated relative to the audio device in an anticlockwise direction by magnitude $\Delta$ so that the rendered sound scene 310 remains fixed in space.

The orientation of the rendered sound scene 310 tracks with the rotation of the listener's head so that the orientation of the rendered sound scene 310 remains fixed in space 320 and does not move with the listener's head 330.

Figure 3:
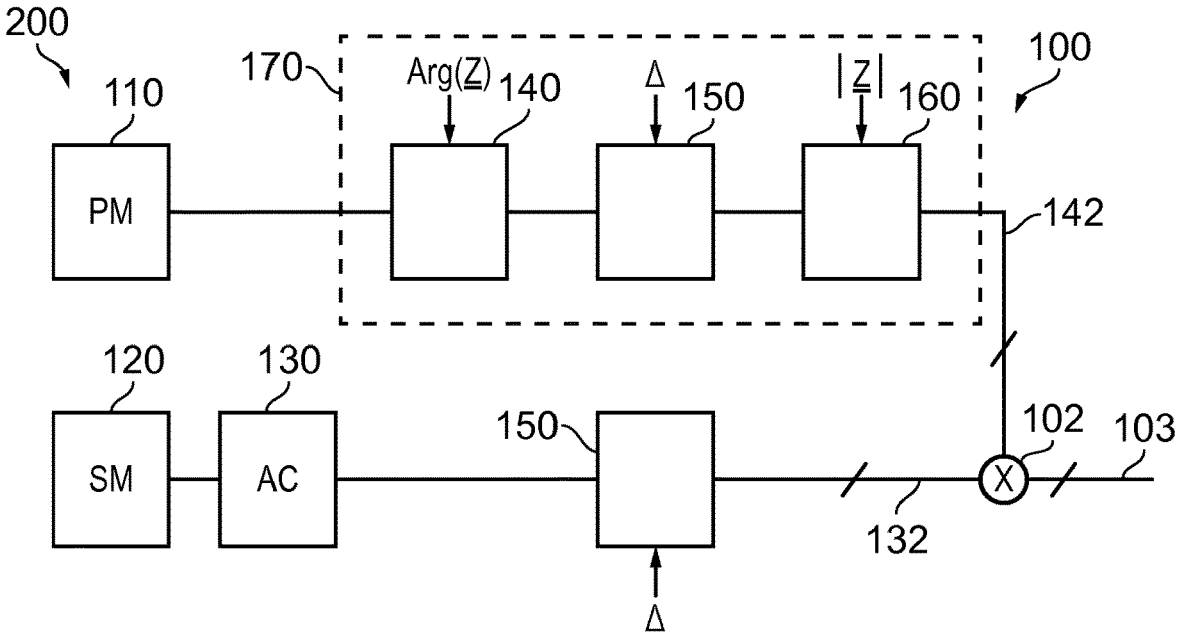
FIG. 3 illustrates a system as illustrated in FIG. 1, modified to rotate the rendered sound scene relative to the recorded sound scene.

FIG. 3 illustrates a system 100 as illustrated in FIG. 1, modified to rotate the rendered sound scene 310 relative to the recorded sound scene 10. This will rotate the rendered sound scene 310 relative to the audio output device 300 which has a fixed relationship with the recorded sound scene 10.

An orientation block 150 is used to rotate the multichannel audio signals 142 by $\Delta$, determined by rotation of the user's head.

Similarly, an orientation block 150 is used to rotate the multichannel audio signals 132 by $\Delta$, determined by rotation of the user's head.

The functionality of the orientation block 150 is very similar to the functionality of the orientation function of the positioning block 140.

The audio coding of the static microphone signals 122 to produce the multichannel audio signals 132 assumes a particular orientation of the rendered sound scene relative to the recorded sound scene. This orientation is offset by $\Delta$. Accordingly, the audio signals 122 are encoded to the multichannel audio signals 132 and the audio signals 112 are encoded to the multichannel audio signals 142 accordingly. The transformation T may be used to rotate the multichannel audio signals 132 within the space defined by those multiple channels by $\Delta$. An additional transformation T may be used to rotate the multichannel audio signals 142 within the space defined by those multiple channels by $\Delta$.

In the example of FIG. 3, the portable microphone signals 112 are additionally processed to control the perception of the distance D of the sound object from the listener in the rendered sound scene, for example, to match the distance $|\underline{z}|$ of the sound object from the origin in the recorded sound scene 10. This can be useful when binaural coding is used so that the sound object is, for example, externalized from the user and appears to be at a distance rather than within the user's head, between the user's ears. The distance block 160 processes the multichannel audio signal 142 to modify the perception of distance.

While a particular order is illustrated for the blocks 140, 150, 160 in FIG. 3, a different order may be used. While different orientation blocks 150 are illustrated as operating separately on the multichannel audio signals 142 and the multichannel audio signals 132, instead a single orientation blocks 150 could operate on the multi-microphone multichannel audio signal 103 after mixing by mixer 102.

Figure 5:
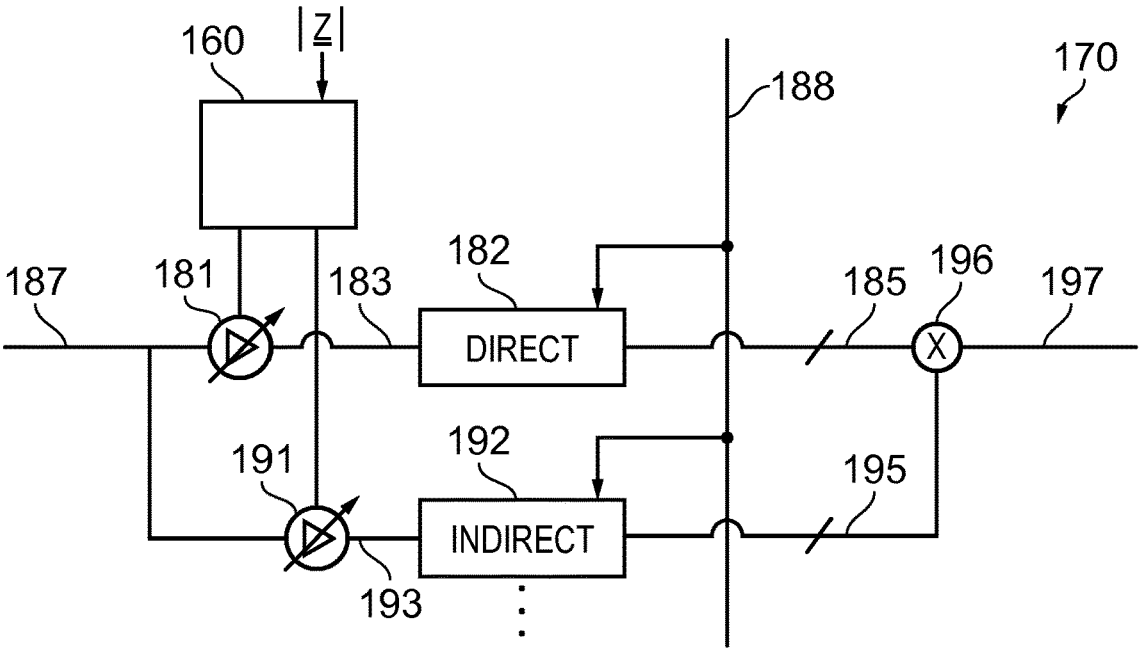
FIG. 5 illustrates a module which may be used, for example, to perform the functions of the positioning block, orientation block and distance block of the system.

FIG. 5 illustrates a module 170 which may be used, for example, to perform the functions of the positioning block 140, orientation block 150 and distance block 160 in FIG. 3. The module 170 may be implemented using circuitry and/or programmed processors such as a computer central processing unit or other general purpose processor controlled by software.

The Figure illustrates the processing of a single channel of the multichannel audio signal 142 before it is mixed with the multichannel audio signal 132 to form the multi-microphone multichannel audio signal 103. A single input channel of the multichannel signal 142 is input as signal 187.

The input signal 187 passes in parallel through a "direct" path and one or more "indirect" paths before the outputs from the paths are mixed together, as multichannel signals, by mixer 196 to produce the output multichannel signal 197. The output multichannel signal 197, for each of the input channels, are mixed to form the multichannel audio signal 142 that is mixed with the multichannel audio signal 132.

The direct path represents audio signals that appear, to a listener, to have been received directly from an audio source and an indirect path represents audio signals that appear to a listener to have been received from an audio source via an indirect path such as a multipath or a reflected path or a refracted path.

The distance block 160 by modifying the relative gain between the direct path and the indirect paths, changes the perception of the distance D of the sound object from the listener in the rendered audio scene 310.

Each of the parallel paths comprises a variable gain device 181, 191 which is controlled by the distance module 160.

The perception of distance can be controlled by controlling relative gain between the direct path and the indirect (decorrelated) paths. Increasing the indirect path gain relative to the direct path gain increases the perception of distance.

In the direct path, the input signal 187 is amplified by variable gain device 181, under the control of the positioning block 160, to produce a gain-adjusted signal 183. The gain-adjusted signal 183 is processed by a direct processing module 182 to produce a direct multichannel audio signal 185.

In the indirect path, the input signal 187 is amplified by variable gain device 191, under the control of the positioning block 160, to produce a gain-adjusted signal 193. The gain-adjusted signal 193 is processed by an indirect processing module 192 to produce an indirect multichannel audio signal 195.

The direct multichannel audio signal 185 and the one or more indirect multichannel audio signals 195 are mixed in the mixer 196 to produce the output multichannel audio signal 197.

The direct processing block 182 and the indirect processing block 192 both receive direction of arrival signals 188. The direction of arrival signal 188 gives the orientation Arg($\underline{z}$) of the portable microphone 110 (moving sound object) in the recorded sound scene 10 and the orientation Δ of the rendered sound scene 310 relative to the audio output device 300.

The position of the moving sound object changes as the portable microphone 110 moves in the recorded sound scene 10 and the orientation of the rendered sound scene 310 changes as the head-mounted audio output device, rendering the sound scene rotates.

Figure 6A:
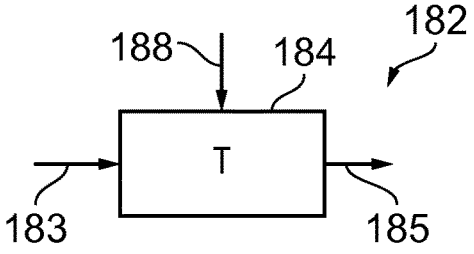
FIGS. 6A and 6B illustrate examples of a direct module and an indirect module for use in the module of FIG. 5.

The direct module 182 may, for example, include a system 184 similar to that illustrated in FIG. 6A that rotates the single channel audio signal, gain-adjusted input signal 183, in the appropriate multichannel space producing the direct multichannel audio signal 185.

The system 184 uses a transfer function to performs a transformation T that rotates multichannel signals within the space defined for those multiple channels by Arg($\underline{z}$) and by Δ, defined by the direction of arrival signal 188. For example, a head related transfer function (HRTF) interpolator may be used for binaural audio.

Figure 6B:
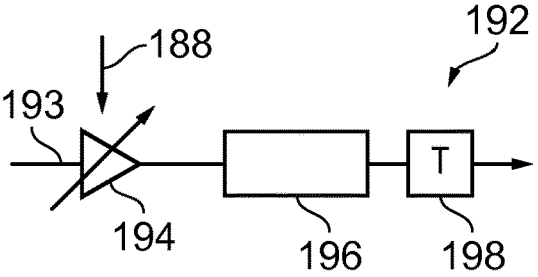

The indirect module 192 may, for example, be implemented as illustrated in FIG. 6B. In this example, the direction of arrival signal 188 controls the gain of the single channel audio signal, the gain-adjusted input signal 193, using a variable gain device 194. The amplified signal is then processed using a static decorrelator 196 and then a system 198 that applies a static transformation T to produce the output multichannel audio signals 193. The static decorrelator in this example use a pre-delay of at least 2 ms. The transformation T rotates multichannel signals within the space defined for those multiple channels in a manner similar to the system 184 but by a fixed amount. For example, a static head related transfer function (HRTF) interpolator may be used for binaural audio.

It will therefore be appreciated that the module 170 can be used to process the portable microphone signals 112 and perform the functions of:

(i) changing the relative position (orientation Arg($\underline{z}$) and/or distance $|\underline{z}|$) of a sound object, represented by a portable microphone audio signal 112, from a listener in the rendered sound scene and (ii) changing the orientation of the rendered sound scene (including the sound object positioned according to (i)) relative to a rotating rendering audio output device 300.

It should also be appreciated that the module 170 may also be used for performing the function of the orientation module 150 only, when processing the audio signals 122 provided by the static microphone 120. However, the direction of arrival signal will include only Δ and will not include Arg($\underline{z}$). In some but not necessarily all examples, gain of the variable gain devices 191 modifying the gain to the indirect paths may be put to zero and the gain of the variable gain device 181 for the direct path may be fixed. In this instance, the module 170 reduces to the system 184 illustrated in FIG. 6A that rotates the recorded sound scene to produce the rendered sound scene according to a direction of arrival signal that includes only Δ and does not include Arg($\underline{z}$).

Figure 7:
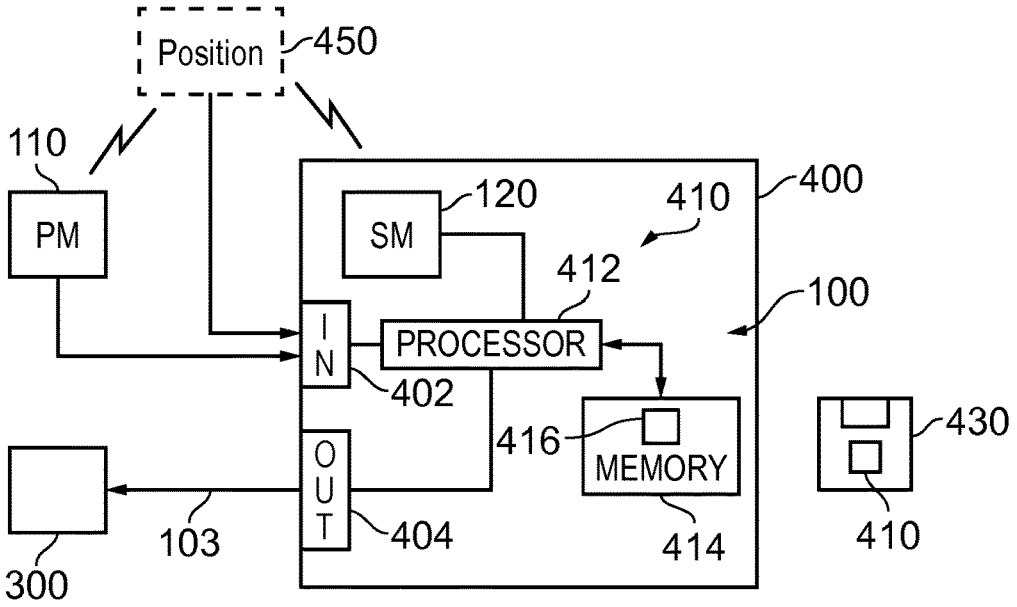
FIG. 7 illustrates an example of the system implemented using an apparatus.

FIG. 7 illustrates an example of the system 100 implemented using an apparatus 400, for example, a portable electronic device 400. The portable electronic device 400 may, for example, be a hand-portable electronic device that has a size that makes it suitable to carried on a palm of a user or in an inside jacket pocket of the user.

In this example, the apparatus 400 comprises the static microphone 120 as an integrated microphone but does not comprise the one or more portable microphones 110 which are remote. In this example, but not necessarily all examples, the static microphone 120 is a microphone array.

The apparatus 400 comprises an external communication interface 402 for communicating externally with the remote portable microphone 110. This may, for example, comprise a radio transceiver.

A positioning system 450 is illustrated. This positioning system 450 is used to position the portable microphone 110 relative to the static microphone 120. In this example, the positioning system 450 is illustrated as external to both the portable microphone 110 and the apparatus 400. It provides information dependent on the position $\underline{z}$ of the portable microphone 110 relative to the static microphone 120 to the apparatus 400. In this example, the information is provided via the external communication interface 402, however, in other examples a different interface may be used. Also, in other examples, the positioning system may be wholly or partially located within the portable microphone 110 and/or within the apparatus 400.

The position system 450 provides an update of the position of the portable microphone 110 with a particular frequency and the term 'accurate' and 'inaccurate' positioning of the sound object should be understood to mean accurate or inaccurate within the constraints imposed by the frequency of the positional update. That is accurate and inaccurate are relative terms rather than absolute terms.

The apparatus 400 wholly or partially operates the system 100 and method 200 described above to produce a multi-microphone multichannel audio signal 103.

The apparatus 400 provides the multi-microphone multichannel audio signal 103 via an output communications interface 404 to an audio output device 300 for rendering.

In some but not necessarily all examples, the audio output device 300 may use binaural coding. Alternatively or additionally, in some but not necessarily all examples, the audio output device may be a head-mounted audio output device.

In this example, the apparatus 400 comprises a controller 410 configured to process the signals provided by the static microphone 120 and the portable microphone 110 and the positioning system 450. In some examples, the controller 410 may be required to perform analogue to digital conversion of signals received from microphones 110, 120 and/or perform digital to analogue conversion of signals to the audio output device 300 depending upon the functionality at the microphones 110, 120 and audio output device 300. However, for clarity of presentation no converters are illustrated in FIG. 7.

Implementation of a controller 410 may be as controller circuitry. The controller 410 may be implemented in hardware alone, have certain aspects in software including firmware alone or can be a combination of hardware and software (including firmware).

As illustrated in FIG. 7 the controller 410 may be implemented using instructions that enable hardware functionality, for example, by using executable instructions of a computer program 416 in a general-purpose or special-purpose processor 412 that may be stored on a computer readable storage medium (disk, memory etc) to be executed by such a processor 412.

The processor 412 is configured to read from and write to the memory 414. The processor 412 may also comprise an output interface via which data and/or commands are output by the processor 412 and an input interface via which data and/or commands are input to the processor 412.

The memory 414 stores a computer program 416 comprising computer program instructions (computer program code) that controls the operation of the apparatus 400 when loaded into the processor 412. The computer program instructions, of the computer program 416, provide the logic and routines that enables the apparatus to perform the methods illustrated in FIGS. 1-10. The processor 412 by reading the memory 414 is able to load and execute the computer program 416.

As illustrated in FIG. 7, the computer program 416 may arrive at the apparatus 400 via any suitable delivery mechanism 430. The delivery mechanism 430 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 416. The delivery mechanism may be a signal configured to reliably transfer the computer program 416. The apparatus 400 may propagate or transmit the computer program 416 as a computer data signal.

Although the memory 414 is illustrated as a single component/circuitry it may be implemented as one or more separate components/circuitry some or all of which may be integrated/removable and/or may provide permanent/semi-permanent/dynamic/cached storage.

Although the processor 412 is illustrated as a single component/circuitry it may be implemented as one or more separate components/circuitry some or all of which may be integrated/removable. The processor 412 may be a single core or multi-core processor.

The foregoing description describes a system 100 and method 200 that can position a sound object within a rendered sound scene and can rotate the rendered sound scene. The system 100 as described has been used to correctly position the sound source within the rendered sound scene so that the rendered sound scene accurately reproduces the recorded sound scene. However, the inventors have realized that the system 100 may also be used to incorrectly position the sound source within the rendered sound scene by controlling $\underline{z}$. In this context, incorrect positioning means to deliberately misposition the sound source within the rendered sound scene so that the rendered sound scene is deliberately, by design, not an accurate reproduction of the recorded sound scene because the sound source is incorrectly positioned.

The incorrect positioning may, for example, involve controlling an orientation of the sound object relative to the listener by controlling the value that replaces $\mathrm{Arg}(\underline{z})$ as an input to the positioning block 140. The value $\mathrm{Arg}(z)$ if represented in spherical coordinate system comprises a polar angle (measured from a vertical zenith through the origin) and an azimuth angle (orthogonal to the polar angle in a horizontal plane).

The incorrect positioning may, for example, involve in addition to or as an alternative to controlling an orientation of the sound object, controlling a perceived distance of the sound object by controlling the value that replaces $|\underline{z}|$ as an input to the distance block 160.

The position of a particular sound object may be controlled independently of other sound objects so that it is incorrectly positioned while they are correctly positioned.

The function of reorienting the sound scene rendered via a rotating head mounted audio output device 300 may still be performed as described above. The incorrect positioning of a particular sound object may be achieved by altering the input to the distance block 160 and/or positioning block 140 in the method 200 and system 100 described above. The operation of the orientation blocks 150 may continue unaltered.

Figure 8:
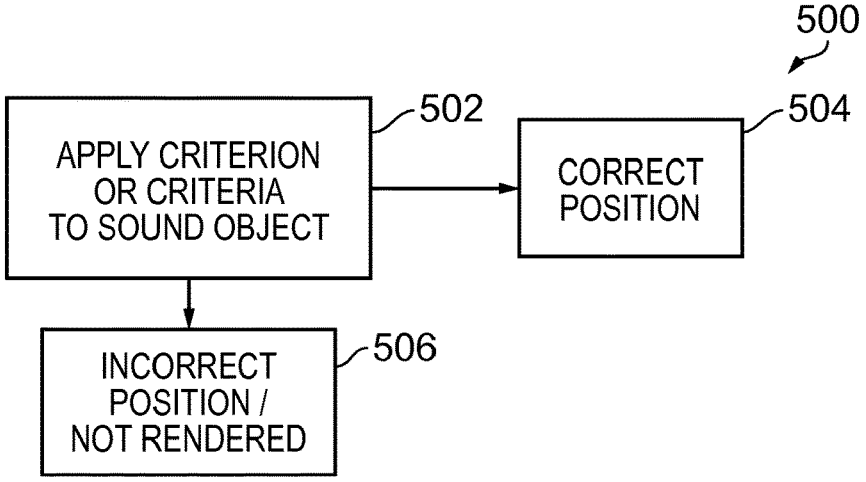
FIG. 8 illustrates an example of a method that automatically applies a selection criterion/criteria to a sound object to decide whether to correctly or incorrectly render the sound object.

FIG. 8 illustrates an example of a method 500 comprising at block 502 automatically applying a selection criterion or criteria to a sound object; if the sound object satisfies the selection criterion or criteria then performing at block 504 one of correct or incorrect rendering of the sound object; and if the sound object does not satisfy the selection criterion or criteria then performing at block 506 the other of correct or incorrect rendering of the sound object.

The method 500 may, for example, be performed by the system 100, for example, using the controller 410 of the apparatus 400.

In one example of the method 500, at block 502, the method 500 automatically applies a selection criterion or criteria to a sound object; if the sound object satisfies the selection criterion or criteria then at block 504 correct rendering of the sound object is performed; and if the sound object does not satisfy the selection criterion or criteria then at block 506 incorrect rendering of the sound object is performed. The selection criterion or criteria may be referred to as "satisfaction then correct rendering" criteria as satisfaction of the criterion or criteria results in correct rendering of the sound object.

In one example of the method 500, at block 502, the method 500 automatically applies a selection criterion or criteria to a sound object; if the sound object satisfies the selection criterion or criteria then at block 506 incorrect rendering of the sound object is performed; and if the sound object does not satisfy the selection criterion or criteria then at block 504 correct rendering of the sound object is performed. The selection criterion or criteria may be referred to as "satisfaction then incorrect rendering" criteria as satisfaction of the criterion or criteria results in incorrect rendering of the sound object.

Correct rendering of a subject sound object comprises at least rendering the subject sound object at a correct position within a rendered sound scene compared to a recorded sound scene. If the rendered sound scene and the recorded sound scene are aligned so that selected sound objects in the scenes have aligned positions in both scenes then the position of the subject sound object in the rendered sound scene is aligned with the position of the subject sound object in the recorded sound scene.

Incorrect rendering of a subject sound object comprises at least rendering of the subject sound object at an incorrect position in a rendered sound scene compared to a recorded sound scene.

Rendering of the subject sound object at an incorrect position in a rendered sound scene means that if the rendered sound scene and the recorded sound scene are aligned so that selected sound objects in the scenes have aligned positions in both scenes then the position of the subject sound object in the rendered sound scene is not aligned, and is deliberately and purposefully misaligned with the position of the subject sound object in the recorded sound scene.

Figure 9A:
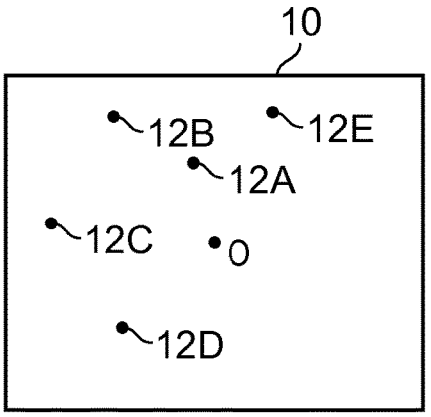
FIG. 9A illustrates a recorded sound scene and FIG. 9B illustrates a corresponding rendered sound scene.

FIG. 9A illustrates a recorded sound scene 10 comprising multiple sound objects 12 at different positions within the sound scene.

Figure 9B:
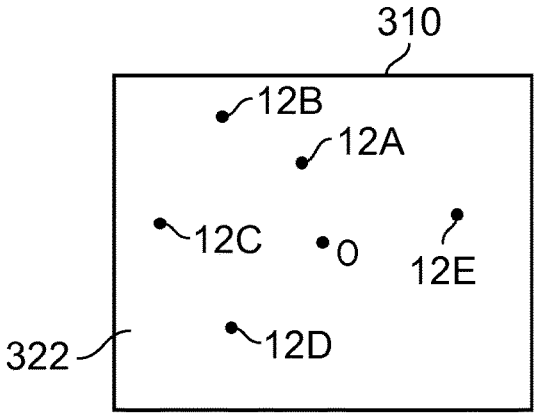

FIG. 9B illustrates a rendered sound scene 310 comprising multiple sound objects 12.

Each sound object 12 has a position z(t) from an origin O of the recorded sound scene 10. Those sound objects 12 that are correctly rendered have the same position z(t) from an origin O of the rendered sound scene 310.

It can be seen from comparing the FIGS. 9A and 9B that the sound objects 12A, 12B, 12C, 12D are correctly rendered in the rendered sound scene 310. These sound objects 12A, 12B, 12C, 12D have the same positions in the recorded sound scene 10 as in the rendered sound scene 310.

It can be seen from comparing the FIGS. 9A and 9B that the sound object 12E is incorrectly rendered in the rendered sound scene 310. This sound object 12E does not have the same position in the recorded sound scene 10 as in the rendered sound scene 310. The position of the sound object 12E in the rendered sound scene 310 is deliberately and purposefully different to the position of the sound object 12E in the recorded sound scene 10.

The method 500 may be applied to some or all of the plurality of multiple sound objects 12 to produce a rendered sound scene 310 deliberately different from the recorded sound scene 10.

The selection criterion or selection criteria used by the method 500 may be the same or different for each sound object 12.

The selection criterion or selection criteria used by the method 500 may assess one or more rendering properties of the sound object 12 to which the selection criterion or selection criteria are applied. A rendering property of a sound object 12 is a property (parameter) of a sound object 12 that affects how that sound object 12 is rendered such as, for example, audio amplitude (frequency independent gain), equalization (frequency dependent gain), reverberation (time-dependent gain). The term 'gain' may be used in this document as a class definition including frequency independent gain, frequency dependent gain, time-dependent gain.

Figure 10:
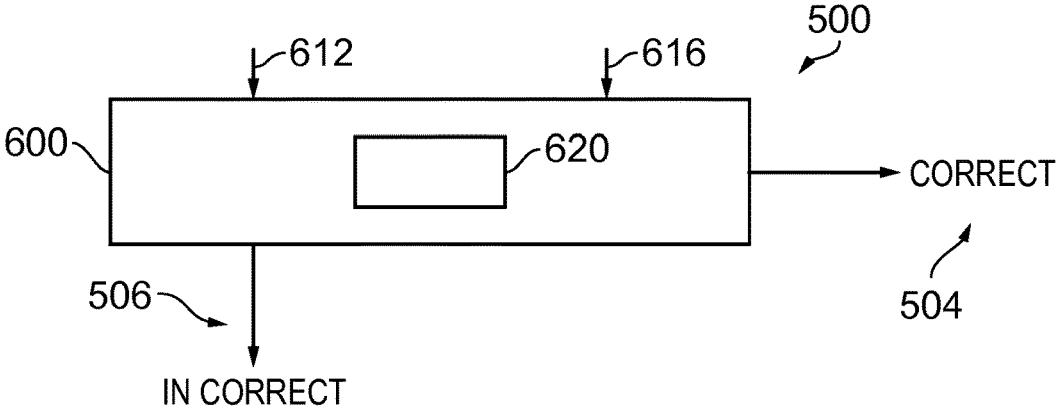
FIG. 10 illustrates an example of a method for applying selection criterion/criteria to sound objects in a recorded audio scene to determine whether to correctly or incorrectly render the sound objects.

FIG. 10 illustrates an example of the method 500 for analyzing each sound object 12 in a rendered audio scene 310. This analysis may be performed dynamically in real time.

In this example, the method 500 is performed by a system 600 which may be part of the system 100 and/or apparatus 400. The system 600 receives information concerning the rendering properties (parameters) of the sound object 12 via one or more inputs 616 and processes them using an algorithm 620 for performing block 502 of the method 500 to decide whether that sound object should be rendered at a correct position 504 or rendered at an incorrect position 506.

The algorithm 620 automatically applies a selection criterion or criteria to the subject sound object 12. If the sound object 12 satisfies the selection criterion or criteria then the algorithm 620 causes performance of one of correct or incorrect rendering of the sound object 12; and if the sound object 12 does not satisfy the selection criterion or criteria then the algorithm 620 causes performance of the other of correct or incorrect rendering of the sound object 12, wherein correct rendering of the sound object 12 comprises at least rendering the sound object at a correct position within a rendered sound scene 310 compared to a recorded sound scene 10 and wherein incorrect rendering of the sound object 12 comprises at least rendering of the sound object 12 at an incorrect position in a rendered sound scene 310 compared to a recorded sound scene 10.

The selection criteria may comprise an independent (orthogonal) criterion for each of the different rendering properties. Each independent criterion may be associated with an independent (orthogonal) change in position of the sound object 12, away from a correct position, when incorrectly rendered. That is each rendering property may have its own independent criterion that causes displacement of a sound object 12 in a particular one of available mutually orthogonal directions.

For example, the selection criteria may comprise a first criterion relating to a first rendering property which if satisfied causes a change in position of the sound object 12 in a first direction. The selection criteria may also comprise a second criterion relating to a second rendering property which if satisfied causes a change in position of the sound object 12 in a second direction, orthogonal to the first direction. The selection criteria may also comprise a third criterion relating to a third rendering property which if satisfied causes a change in position of the sound object 12 in a third direction, orthogonal to the first direction and orthogonal to the second direction.

The first rendering property, the second rendering property and the third rendering property may, for example, comprise one or more gain parameters.

The first rendering property may, for example, be audio amplitude (frequency independent gain). The second rendering property may, for example, be equalization (frequency dependent gain). The third rendering property may, for example, be reverberation (time-dependent gain).

The first direction, the second direction and the third direction may, for example, comprise one or more orthogonal directions in a coordinate system e.g. polar angle, azimuthal angle, radius in a spherical coordinate system or left-right, up-down, forward-back in a Cartesian coordinate system.

Thus each of the different rendering properties is associated with a different orthogonal change in position of the sound object 12 causing rendering of the sound object 12 at an incorrect position.

In the example of FIG. 10, a necessary condition for selection of a subject sound object 12 for incorrect rendering is that a rendering property of the subject sound object 12 exceeds a threshold T. There may be a different threshold T for each rendering property.

The threshold T may be fixed or it may be variable.

A variable threshold T for a subject rendering property may be dependent upon analysis of the subject rendering property for at least some of the sound objects 12 in the sound scene. The analysis may, for example, involve all sound objects 12 in the rendered sound scene 310 or may involve only a subset of all sound objects 12 in the rendered sound scene 310, for example nearest neighbor sound objects 12.

For example, it may be desirable that a characteristic dependent upon the subject rendering property of the subject sound objects 12 does not exceed a maximum cumulative value for the rendered sound scene 310. By analyzing the current values of the subject rendering property for each of the sound objects 12 except the subject sound object 12 and comparing the combination against the maximum cumulative value it is possible to determine a maximum value of the subject rendering property for the subject sound object 12 and this may be set equal to the threshold T.

If the user of the system attempts to increase the subject rendering property of the subject sound object 12 past that threshold T, then the criterion is satisfied and algorithm 620 causes the position of the subject sound object 12 to change instead of continuing to increase the subject rendering property of the subject sound object 12.

If any of the values of the subject rendering property for the other sound objects 12 change then the threshold T can be recalculated.

In this way a threshold T can be calculated for one or more sound objects 12, for one or more rendering properties.

Although in this example, reference has been made to the characteristic dependent upon the subject rendering property of the subject sound object 12 not exceeding a maximum cumulative value for the rendered sound scene 310 with the consequent determination of an upper boundary threshold T that is exceeded and the criterion satisfied by increasing the subject rendering property of the subject sound object 12 past that upper boundary threshold T, in other examples the characteristic dependent upon the subject rendering property of the subject sound object 12 may not decrease below a minimum cumulative value for the rendered sound scene 310 with the consequent determination of a lower boundary threshold that is exceeded and the criterion satisfied by decreasing the subject rendering property of the subject sound object 12 below that lower boundary threshold.

When the subject rendering property for a subject sound object 12 exceeds a threshold T, that sound object 12 is misplaced. It is placed at an incorrect position in the rendered sound scene 310. The difference between the correct position and the incorrect position is a displacement. The displacement may be a fixed value once the threshold T is exceeded or a variable value that changes with the amount the threshold T is exceeded by. For example the displacement may be dependent, for example linearly dependent, upon how much the threshold T is exceeded by.

The displacement may be dependent upon the rendering properties of the other sound objects 12 in the rendered sound scene and may be calculated by analyzing the subject rendering property of some or all of the sound objects 12 in the rendered sound scene 310. The displacement may, for example, be controlled to separate the subject sound object 12 spatially from all or selected other sound objects 12 in the rendered sound scene 310.

Figure 11A:
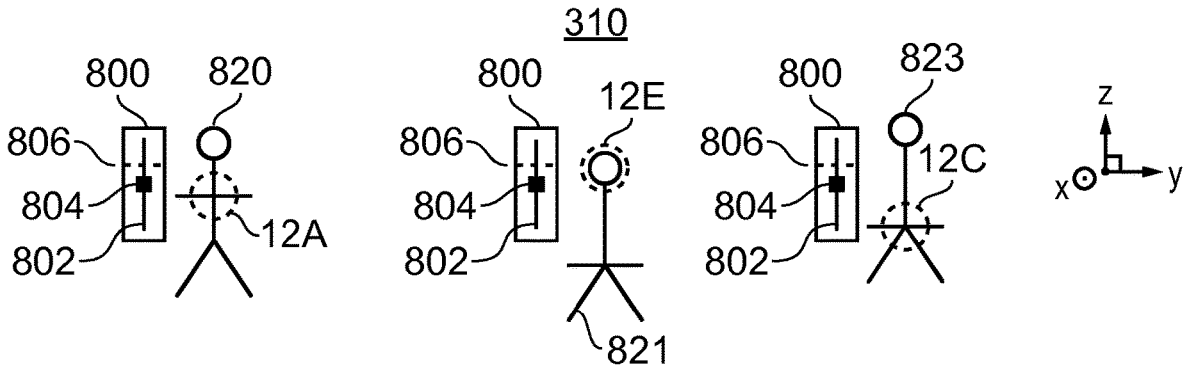
FIGS. 11A and 11B illustrates an example of how a user may control the rendering properties of the sound objects individually and cause automatic repositioning of a sound object by varying its rendering property beyond a threshold.
Figure 11B:
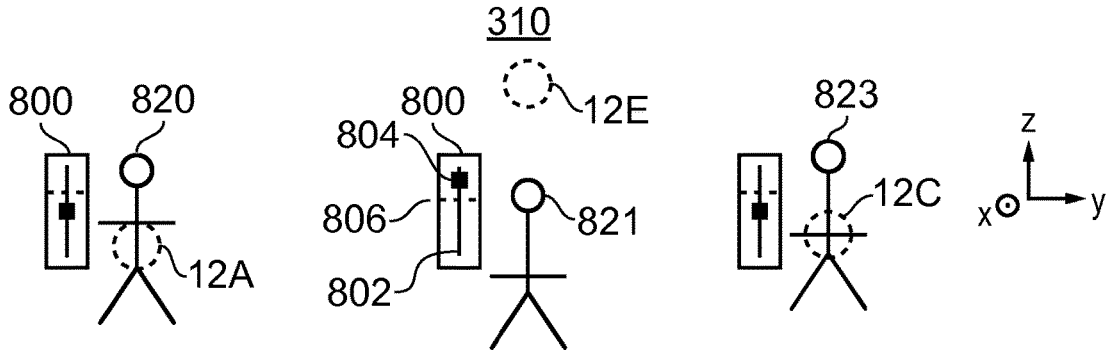

A user of the apparatus 400 may be able to control the rendering properties of the sound objects 12 individually, for example, as illustrated in FIGS. 11A and 11B.

In this example, a necessary (and sufficient) condition for selection of a sound object 12 for incorrect rendering is that the audio amplitude (frequency independent gain) of the sound object 12 exceeds a threshold T. There may be a different threshold T for each sound object 12 and the threshold T may be dynamically determined.

For example, it may be desirable that a characteristic (e.g. power output) dependent upon the audio amplitude of the sound objects 12 does not exceed a maximum cumulative value for the rendered sound scene 310. By analyzing the current values of the audio amplitude for each of the sound objects 12 except the subject sound object 12 and comparing the combination against the maximum cumulative value it is possible to determine a maximum value of the audio amplitude for the subject sound object 12 and this may be set equal to the threshold T.

If the user of the system attempts to increase the audio amplitude of the subject sound object 12 past the threshold T, then the criterion is satisfied and the position of the subject sound object 12 changes instead of continuing to increase the audio amplitude of the subject sound object 12.

If any of the audio amplitudes of the sound objects 12 are changed then the thresholds T for the sound objects 12 can be recalculated.

In FIG. 11A, at a first time, the rendered sound scene 310 comprises three sound objects 12A, 12E, 12C associated with respective performers 820, 821, 823.

Each of the rendered sound objects 12A, 12E, 12C is also represented visually in video in a mediated reality display and associated with each sound object 12 is a user interface 800, in the mediated reality display, for controlling the audio amplitude of the associated sound object 12.

The user interface 800 allows the user to increase and decrease the audio amplitude of the associated sound object 12. The user interface 800 may comprise an indication 806 of the threshold T.

In this example the user interface 800 comprises a slider 804 that is moved along a slide 802.

In FIG. 11B, the slider 804 for the user interface 800 associated with the sound object 12E of performer 821 is slid upwards to and beyond the threshold T by a user.

As the slide 804 moves upwards towards the threshold T the audio amplitude of the sound object 12E increases.

As the slider 804 moves upwards past the threshold T the audio amplitude of the sound object 12E no longer increases, instead the position of the sound object 12E changes increasing in height. Other additional or different changes in direction are possible.

When the audio amplitude for the sound object 12E exceeds the threshold T, that sound object 12 is mispositioned by a variable vertical displacement that changes, for example linearly, with the amount the threshold is exceeded by. The displacement separates the subject sound object 12E spatially from other sound objects 12 in the rendered sound scene.

In some but not necessarily all examples, the system 600 may determine a weighted average position of all or some of the sound sources 12 when correctly rendered. This provides a center point of the rendered sound scene 310. The weighting will be in respect of the subject rendering property.

An orthogonal coordinate system may be placed at that center point to measure displacement. In the examples of FIGS. 11A and 11B a Cartesian x-y-z orthogonal coordinate system is illustrated, however, for convenience of illustration it is offset by +Y in the y-direction from the center point. However, other coordinate systems may be used. The center point of the sound scene lies at the intersection of the orthogonal vectors x, y, z spanning the sound scene.

In this example, the most effective separation of the sound object 12E is achieved by displacement in the z-direction. This can be determined by making a putative displacement of the sound object 12E and recalculating the center point for the rendered sound scene 310 having the sound object 12E so displaced, the difference in location of the recalculated incorrectly positioned putative center point compared to the original 'correctly positioned' center point is indicative of the amount of separation achieved by the putative displacement. If putative displacements are made in the three orthogonal directions, the direction that has the greatest difference achieves the most separation. In this example, that direction is the z-direction i.e. elevation whether in a positive sense (upwards) or a negative sense (downwards) and either sense of displacement may be used.

Figure 12:
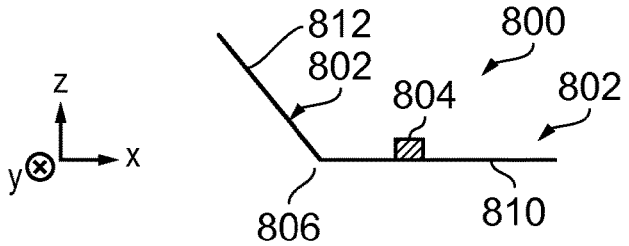
FIG. 12 illustrates an example of a user interface that is rendered visually in three-dimensions using mediated reality.

FIG. 12 illustrates an example of a user interface 800 that is rendered visually in three-dimensions using mediated reality.

The three dimensional user interface 800 is associated with a particular sound object 12 (the subject sound object) and with a particular rendering property (the subject rendering property).

The three dimensional user interface 800 is similar, in plan view, to those illustrated in FIGS. 11A and 11B. The user interface 800 comprises a slide 802 extending in a first direction (x direction, negative sense) towards an indication 806 of the threshold T and then extending in both the first direction (x-direction, negative sense) at a second direction (z-direction, positive sense) beyond the indication 806 of the threshold T. A change in direction (z-direction, positive sense) between the first direction and the second direction is aligned with the displacement from a correct position of the subject sound object 12 in the rendered sound scene 310 to the incorrect position of the subject sound object 12 in the rendered sound scene 310. The slide 802 has an elbow or change of direction at the indication 806 of the threshold.

As the slider 804 of the 3D user interface 800 is moved along the slide 802 in only the first direction, then the subject rendering property for the subject sound object 12 varies until it reaches the indication 806 of the threshold T and then it stops varying and remains constant.

As the slider 804 of the 3D user interface 800 is moved further along the slide 802 in the first direction past the indication 806 of the threshold T, then it also starts to be displaced in the second direction (z-direction, positive sense) and simultaneously the subject sound object 12 is automatically displaced in the rendered sound scene 310 in the same second direction (z-direction, positive sense).

The shape and orientation of the 3D user interface 800 may be dependent upon the subject rendering property it is used to control and the subject sound object 12 it is associated with. The threshold T may be dependent upon the subject rendering property, the subject sound object, other sound objects 12. A change in the threshold T changes a position of the indication 806 of the threshold T in the 3D user interface 800 i.e. changes a position of the elbow. The direction in which the 3D user interface 800 is displaced after the indication 806 of the threshold T is exceeded may be fixed or may be variable, for example, it may be dependent upon which displacement direction of the subject sound object 12 effectively or most effectively separates it from other, for example neighboring, sound objects 12 in the rendered sound scene 310.

It will be appreciated from the foregoing that the various methods 500 described may be performed by an apparatus 400, for example an electronic apparatus 400.

The electronic apparatus 400 may in some examples be a part of an audio output device 300 such as a head-mounted audio output device or a module for such an audio output device 300.

It will be appreciated from the foregoing that the various methods 500 described may be performed by a computer program 416 used by such an apparatus 400.

For example, an apparatus 400 may comprises:

at least one processor 412; and at least one memory 414 including computer program code;

the at least one memory 414 and the computer program code configured to, with the at least one processor 412, cause the apparatus 400 at least to perform:

automatically applying a selection criterion or criteria to a sound object 12;

if the sound object 12 satisfies the selection criterion or criteria then causing performance of one of correct 504 or incorrect 506 rendering of the sound object 12; and if the sound object 12 does not satisfy the selection criterion or criteria then causing performance of the other of correct 504 or incorrect 506 rendering of the sound object 12, wherein correct rendering 504 of the sound object 12 comprises at least rendering the sound object 12 at a correct position $\underline{z}(t)$ within a rendered sound scene 310 compared to a recorded sound scene 10 and wherein incorrect rendering 506 of the sound object 12 comprises at least rendering of the sound object 12 at an incorrect position in a rendered sound scene 310 compared to a recorded sound scene 10.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present. This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks illustrated in the FIGS. 1-10 may represent steps in a method and/or sections of code in the computer program 416. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

at least one processor; and at least one non-transitory memory including computer program code, the at least one memory and the computer program code configured to, with the at least one processor, cause the apparatus to perform at least the following:

apply a selection criterion or criteria to a sound object present in a recorded sound scene, wherein the selection criterion or criteria assess one or more rendering properties of sound of the sound object, wherein at least one of the one or more rendering properties comprises one of:

amplitude, equalization, or reverberation;

where the sound object satisfies the selection criterion or criteria, perform one of correct or incorrect rendering of the sound object; and where the sound object does not satisfy the selection criterion or criteria, perform the other of correct or incorrect rendering of the sound object, wherein the correct rendering of the sound object comprises at least rendering the sound object present in the recorded sound scene at a correct position within a rendered sound scene compared to the recorded sound scene, and wherein the incorrect rendering of the sound object comprises at least rendering the sound object present in the recorded sound scene at an incorrect position in the rendered sound scene compared to the recorded sound scene.

2. An apparatus as claimed in claim 1, wherein the recorded sound scene comprises multiple sound objects at different positions within the recorded sound scene.

3. An apparatus as claimed in claim 1, wherein the rendered sound scene is rendered with a fixed orientation in space despite a change in orientation in space of a head-mounted audio device rendering the rendered sound scene, wherein rendering comprises reorienting the rendered sound scene relative to the head-mounted audio device.

4. An apparatus as claimed in claim 1, wherein rendering the sound object at the incorrect position comprises rendering the sound object in an incorrect position relative to other sound objects in the rendered sound scene, whether or not the rendered sound scene is reoriented relative to a head-mounted audio device.

5. An apparatus as claimed in claim 1, wherein the selection criteria comprises a first criterion relating to a first rendering property, wherein satisfaction of the first criterion causes a change in position of the sound object in a first direction, wherein the selection criteria comprises a second criterion relating to a second rendering property, wherein satisfaction of the second criterion causes a change in position of the object in a second direction, wherein the second direction is orthogonal to the first direction.

6. An apparatus as claimed in claim 1, wherein a necessary condition for selection of the sound object for the incorrect rendering is that a rendering property of the sound object exceeds a threshold as a result of applied user control to the rendering property.

7. An apparatus as claimed in claim 6, wherein a user interface is used to apply user control to the rendering property, wherein the threshold is indicated on the user interface.

8. An apparatus as claimed in claim 7, wherein the user interface is a three dimensional user interface comprising a slider extending in a first direction towards an indication of the threshold and extending in a second direction beyond the indication of the threshold, wherein a change in direction between the first direction and the second direction is aligned with a difference between the correct position of the sound object in the rendered sound scene and the incorrect position of the sound object in the rendered sound scene.

9. An apparatus as claimed in claim 6, wherein the threshold is determined based on analysis of multiple sound objects within the rendered sound scene.

10. An apparatus as claimed in claim 1, wherein the incorrect position is determined to separate the sound object spatially from other sound objects in the rendered sound scene.

11. An apparatus as claimed in claim 1, wherein rendering the sound object at the incorrect position comprises rendering the sound object at an incorrect vertical position and/or incorrect lateral position and/or incorrect distance.

12. A method comprising:

applying a selection criterion or criteria to a sound object present in a recorded sound scene, wherein the selection criterion or criteria assess one or more rendering properties of sound of the sound object, wherein at least one of the one or more rendering properties comprises one of:
amplitude,
equalization, or
reverberation;

where the sound object satisfies the selection criterion or criteria, performing one of correct or incorrect rendering of the sound object; and where the sound object does not satisfy the selection criterion or criteria, performing the other of correct or incorrect rendering of the sound object, wherein the correct rendering of the sound object comprises at least rendering the sound object present in the recorded sound scene at a correct position within a rendered sound scene compared to the recorded sound scene, and wherein the incorrect rendering of the sound object comprises at least rendering the sound object present in the recorded sound scene at an incorrect position in the rendered sound scene compared to the recorded sound scene.

13. A method as claimed in claim 12, wherein the recorded sound scene comprises multiple sound objects at different positions within the recorded sound scene and wherein the rendered sound scene is different from the recorded sound scene.

14. A method as claimed in claim 12, wherein the rendered sound scene is rendered with a fixed orientation in space despite a change in orientation in space of a head-mounted audio device rendering the rendered sound scene, wherein rendering comprises reorienting the rendered sound scene relative to the head-mounted audio device.

15. A method as claimed in claim 12, wherein rendering the sound object at the incorrect position comprises rendering the sound object in an incorrect position relative to other sound objects in the rendered sound scene, whether or not the rendered sound scene is reoriented relative to a head-mounted audio device.

16. A method as claimed in claim 12, wherein a necessary condition for selection of the sound object for the incorrect rendering is that a rendering property of the one or more rendering properties of the sound object exceeds a threshold as a result of applied user control to the rendering property.

17. At least one non-transitory computer readable medium comprising instructions that, when executed, perform at least the following:

apply a selection criterion or criteria to a sound object present in a recorded sound scene, wherein the selection criterion or criteria assess one or more rendering properties of sound of the sound object, wherein at least one of the one or more rendering properties comprises one of:
amplitude,
equalization, or
reverberation;

where the sound object satisfies the selection criterion or criteria, perform one of correct or incorrect rendering of the sound object; and where the sound object does not satisfy the selection criterion or criteria, perform the other of correct or incorrect rendering of the sound object, wherein the correct rendering of the sound object comprises at least rendering the sound object present in the recorded sound scene at a correct position within a rendered sound scene compared to the recorded sound scene, and wherein the incorrect rendering of the sound object comprises at least rendering the sound object present in the recorded sound scene at an incorrect position in the rendered sound scene compared to the recorded sound scene.

* * * * *